United States Patent [19]

Jenkins

[11] Patent Number: 4,602,399

[45] Date of Patent: Jul. 29, 1986

[54] BRIDGE TRANSPORTING AND LAUNCHING TRAILER AND METHOD

[75] Inventor: Arthur B. Jenkins, York, Pa.

[73] Assignee: Harsco Corporation, Wormleysburg, Pa.

[21] Appl. No.: 613,427

[22] Filed: May 24, 1984

[51] Int. Cl.[4] ..... E01D 15/12

[52] U.S. Cl. ..... 14/2.4; 180/208; 280/401; 414/498

[58] Field of Search ..... 14/2.4, 2.6; 414/498, 414/500; 180/208; 280/80 A, 401

[56] References Cited

U.S. PATENT DOCUMENTS

| | | | |
|---|---|---|---|
| 2,556,175 | 6/1951 | Frost | 14/2.4 |
| 2,636,197 | 4/1953 | Odot | 14/2.6 |
| 3,305,885 | 2/1967 | Vaillant et al. | 14/2.4 |
| 3,488,787 | 1/1970 | Soffge | 14/2.4 |
| 3,491,391 | 1/1970 | Soffge | 14/2.4 |
| 3,845,514 | 11/1974 | Wagner | 14/2.4 |
| 3,964,625 | 6/1976 | Wirt | 414/498 X |
| 3,985,254 | 10/1976 | Grandury | 52/143 X |
| 4,062,081 | 12/1977 | Ramer | 14/2.4 X |
| 4,147,266 | 4/1979 | Corompt | 414/498 X |
| 4,510,637 | 4/1985 | Zlotnicki | 14/2.4 |

FOREIGN PATENT DOCUMENTS

| | | | |
|---|---|---|---|
| 2262094 | 6/1974 | Fed. Rep. of Germany | 280/401 |
| 2711825 | 9/1977 | Fed. Rep. of Germany | 414/498 |
| 859277 | 12/1940 | France | 14/2.4 |
| 1397242 | 5/1966 | France . | |
| 2088447 | 6/1982 | United Kingdom | 14/2.4 |

*Primary Examiner*—Stephen J. Novosad
*Assistant Examiner*—John F. Letchford
*Attorney, Agent, or Firm*—Kerkam, Stowell, Kondracki & Clarke

[57] ABSTRACT

A bridge carrying and launching trailer includes a tilt frame mounted to a trailer frame. The tilt frame includes a foot portion which rests upon the ground when launching a bridge. The trailer relies upon the weight of another vehicle to counter the moment caused by launching an unfolding type military bridge. One or more control cables extend from the trailer to the other vehicle, preferably an armored vehicle such as a tank, to allow remote control of the bridge launching sequence. The trailer includes a redundant hydraulic system and mechanical components such that a bridge may be launched even if one of the two hydraulic systems is damaged. The bridge launching trailer is especially adapted to fit in compact places such as an airplane cargo bay. A tongue, which serves as an interfacing member between the trailer and a bridge mounted on the trailer, is adapted to nest within the trailer, thus allowing a bridge to have its width reduced while resting upon the trailer and facilitating the loading of the trailer into the airplane cargo bay with the bridge resting on the trailer. A unique method of loading the bridge into a compact space utilizes the ability of the tongue to nest within the trailer frame.

33 Claims, 11 Drawing Figures

BRIDGE TRANSPORTING AND LAUNCHING TRAILER AND METHOD

BACKGROUND OF THE INVENTION

The present invention relates to bridge transporting and launching trailers. More specifically, this invention relates to a trailer which may be used for quickly establishing a bridge.

Bridge launchers of various constructions have heretofore been known in the art. Such bridge launchers have usually been designed to function in military support roles for tanks, armored personnel carriers, military trucks, and similar military vehicles. To this end, the bridge launcher is used to establish a temporary bridge across a river, gully, or anti-tank ditch. Once the bridge has been established across the river, gully, or ditch, tanks or other military vehicles may proceed across the bridge to the other side of the otherwise impassable barrier.

Usually the bridge can be removed by the same vehicle used for launching the bridge so that the bridge may be used at the next obstacle. Also, removing the bridge will prevent enemy forces from using it without requiring the destruction of the bridge.

Bridge launching vehicles commonly must be used in rough terrain and are often carried by endless track vehicles constructed with the same traction, power drive mechanisms, and chassis as commonly used on tanks. In addition to providing traction in rough terrain, the mounting of the bridge and associated launching mechanism on top of an armored body of a military track vehicle will additionally protect military personnel while launching and retrieving the bridge. Clearly it can be expected that heavy enemy fire will be concentrated upon any bridge launching vehicle used under battlefield conditions. Unfortunately, the armor which is necessary to provide protection for the military personnel who launch and retrieve the bridge, also causes the bridge launching vehicle to be extremely heavy and relatively bulky. Excessive weight and bulkiness increases the difficulties in transporting such bridge launching vehicles by ship or plane to the battlefield location. Additionally, the armor plating and endless track on such vehicles is relatively expensive as is the cost of transporting the vehicles.

Among other problems associated with the manufacture of bridge launchers are the limitations in the weight and/or length of the bridge which can be safely launched from the vehicle. Specifically, the launching of a bridge may place great moments on the vehicle which could cause tipping of the vehicle. In order to avoid tipping, anchors or similar devices are often used to resist tipping of the vehicle at the bridge launching end. Even with such anchors, the bridge weight and/or length will be restricted in accordance with the limit of compression of the anchor or anchors and the weight of the bridge launching vehicle itself. By use of an anchor or anchors, the weight of the vehicle may be used to counter the moment encountered when launching the bridge. Accordingly, the stability of the bridge launching vehicle will be enhanced by increasing its weight relative to that of the bridge itself. However, an increase in vehicle weight may hinder or complicate transportation of the bridge launching vehicle.

Another problem with prior art bridge launchers is the inability to adapt to structural modifications. Not only have prior art bridge launching vehicles been limited in terms of the maximum length and weight of the bridges which can be launched, but they have also often been limited to launching of a particular length and/or weight bridge. Any significant change of bridge weight and/or length has commonly required redesign of the launching vehicle.

Another disadvantage of numerous prior art bridge launching vehicles is their complexity in construction and associated high cost. In particular, it is desirable to have the bridge launching vehicle carry the bridge with the center of gravity of the bridge above or approximately above the center of gravity of the bridge launching vehicle. This maintains the bridge launching vehicle quite stable while the vehicle is being moved. However, when launching the bridge, relatively complex mechanisms have often been required to move the bridge to the front (or back) of the vehicle and to launch the bridge without putting too great a moment on the bridge launching vehicle.

Still another problem with prior art bridge launchers is that their relatively slowness in launching a bridge. For military operations this may present an intolerably long time during which the bridge and launcher is highly vulnerable to enemy fire.

Prior art methods of transporting bridge launching vehicles typically use a helicopter, the vehicle being attached by cables. Prior art bridge launchers generally are too cumbersome to allow their transportation by airplane without separation of the bridge from the launching vehicle and/or substantial disassembly of the vehicle.

OBJECTS OF THE INVENTION

Accordingly, it is a primary object of the present invention to provide a new and improved bridge transporting and launching trailer.

A more specific object of the present invention is to provide a bridge transporting and launching trailer which is relatively light in weight.

Another object of the present invention is to provide a bridge transporting and launching trailer which is stable when being towed and stable when launching a bridge.

Another object of the present invention is to provide a bridge transporting and launching trailer which is adaptable for different weights and lengths of bridges.

Yet another object of the present invention is to provide a bridge transporting and launching trailer which is relatively simple in construction and relatively inexpensive.

A further object of the present invention is to provide a bridge transporting and launching trailer which is operable to quickly launch a bridge across a gap or other obstacle.

A further object of the present invention is to provide a bridge transporting and launching trailer which is operable by an operator or operators in another vehicle.

A still further object of the present invention is to provide a bridge transporting and launching trailer which may be easily compacted for transportation within another vehicle.

Yet another object of the present invention is to provide a method of loading a bridge transporting and launching trailer and bridge mounted thereon into a compact space such as an airplane cargo compartment.

SUMMARY OF THE INVENTION

The above and other objects of the present invention which will become apparent as the description proceeds are realized by a bridge transporting and launching trailer comprising: a trailer frame having right and left trailer frame members attached together and extending from a front to a back; right and left wheels mounted to the trailer frame and operable in a support position to support the trailer; a tilt frame having right and left tilt frame members attached together and extending from a front to a back, the tilt frame being pivotably attached at a fixed tilt axis at the back of the trailer frame; a foot portion mounted at the back of the tilt frame and extending between the right and left tilt frame members; an extendable length first tilt actuator attached to the front of the tilt frame and attached to the trailer frame; an interfacing member operable to mount a bridge to the tilt frame, the interfacing member being pivotably mounted at an interface axis disposed at the back of the tilt frame and including bridge securing means for selectively securing a bridge to the trailer; and an extendable length first interface actuator attached to the interfacing member and operable to pivot the interfacing members; and wherein the trailer is disposable in: I. a normal position for carrying a bridge and having the tilt frame disposed at or below a plane defined by the tops of the right and left trailer frame members, the first tilt actuator in a retracted position, and the first interface actuator in a retracted position; and II. a launch position for launching a bridge and having the tilt frame tilted about the tilt frame axis relative to the trailer frame, the foot portion on the ground, the first tilt actuator in an extended position, and the first interface actuator in an extended position. In the normal position, the interfacing member extends at least partially above the plane for attachment of the bridge securing means to a bridge. The trailer is further disposable in: III. a compact position with the interfacing member disposed completely below the plane. In the compact position, the right and left wheels are moved out of their support positions. The right and left wheels are mounted to a common wheel support removably attachable to the trailer frame, and, in the compact position, the common wheel support is removed from the trailer frame. The trailer further comprises an intermediate member pivotably attached to the tilt frame at an interface axis and an extendable length first intermediate actuator attached to the intermediate member and the tilt frame, and wherein the first interface actuator is attached to the intermediate member. The trailer further comprises an extendable length second tilt actuator attached to the front of the tilt frame and attached to the trailer frame, and an extendable length second interface actuator attached to the interfacing member and operable to pivot the interfacing member. The trailer further comprises a control cord extending from the trailer and operable to control the launching of a bridge from the trailer by an operator in another vehicle. The trailer is adjustable in length to accommodate different length bridges. The trailer is operable to avoid tipping when launching a bridge by relying upon the weight of a towing vehicle attached to the front of the trailer.

The present invention may alternately be described as a bridge transporting and launching trailer comprising: a trailer frame having right and left trailer frame members attached together and extending from front to back; right and left wheels mounted to the trailer frame and operable in a support position to support the trailer; a tilt frame having right and left tilt frame members attached together and extending from front to back, the tilt frame being pivotably attached at a tilt axis at the back of the trailer frame; a foot portion mounted at the back of the tilt frame and extending between the right and left tilt frame members; an extendable length first tilt actuator attached to the front of the tilt frame and attached to the trailer frame; an interfacing member operable to mount a bridge to the tilt frame, the interfacing member being pivotably mounted at an interface axis disposed at the back of the tilt frame and including bridge securing means for selectively securing a bridge to the trailer; and an extendable length first interface actuator attached to the interfacing member and operable to pivot the interfacing member; and wherein the trailer is disposable in: I. a normal position for carrying a bridge and having the front of the tilt frame relatively close to the front of the trailer frame, the first tilt actuator in a retracted position, the second interface actuator in a retracted position, and the interfacing member extending at least partially above a plane defined by upper edges of the right and left trailer frame members to allow attachment of the bridge securing means to a bridge; II. a launch position for launching a bridge and having a tilt frame tilted about the tilt axis relative to the trailer frame such that the front of the tilt frame is relatively far from the front of the trailer frame, the foot portion on the ground, the first tilt actuator in an extended position, and the first interface actuator in an extended position; and III. a compact position with the interfacing member disposed completely below the plane, the bridge securing means being incapable of securing a bridge to the interfacing member when in the compact position. The trailer is operable to avoid tipping when launching a bridge by relying upon the weight of a towing vehicle attached to the front of the trailer. The tilt axis is fixed relative to the trailer frame. In the compact position, the right and left wheels are moved out of their support positions. The right and left wheels are mounted to a common wheel support removably attachable to the trailer frame, and, in the compact position, the common wheel support is removed from the trailer frame. The tilt frame and trailer frame are parallel in the normal position. The trailer further comprises an intermediate member pivotably attached to the tilt frame at the interface axis and an extendable length first intermediate actuator attached to the intermediate member and the tilt frame, and wherein the interface actuator is attached to the intermediate member. The trailer further comprises a control cord extending from the trailer and operable to control the launching of a bridge from the trailer by an operator in another vehicle.

The present invention may alternately be described as a bridge transporting and launching trailer comprising: a trailer frame having right and left trailer frame members attached together and extending from front to back; right and left wheels mounted to the trailer frame and operable in a support position to support the trailer; a tilt frame having right and left tilt frame members attached together and extending from front to back, the tilt frame being pivotably attached at a tilt axis to the back of the trailer frame; a foot portion mounted at the back of the tilt frame and extending between the right and left tilt frame members; an extendable length first tilt actuator attached to the front of the tilt frame and attached to the trailer frame; an interfacing member operable to mount a bridge to the tilt frame, the interfacing member being pivotably mounted at an interface axis disposed at the back of the tilt frame and including bridge securing means for selectively securing a bridge to the trailer; and an extendable length first interface actuator attached to the interfacing member and operable to pivot the interfacing member; and wherein the trailer is disposable in: I. a normal position for carrying a bridge and having the front of the tilt frame relatively close to the front of the trailer frame, the first tilt actuator in a retracted position, the first interface actuator in a retracted position, and the interfacing member extending at least partially above a plane defined by top edges of the right and left trailer frame members to allow attachment of the bridge securing means to a bridge; II. a launch position for launching a bridge and having the tilt frame tilted about the tilt axis relative to the trailer frame such that the front of the tilt frame is relatively far from the front of the trailer frame, the foot portion on the ground, the first tilt actuator in an extended position and the first interface actuator in an extended position; and wherein the right and left wheels are mounted to a common wheel support removably attachable to the trailer frame. The trailer further comprises a control cord extending from the trailer and operable to control the launching of a bridge from the trailer by an operator in another vehicle. The trailer is operable to avoid tipping during the launching of a bridge by relying upon the weight of a vehicle attached to the front of the trailer. The trailer further comprises an intermediate member pivotably attached to the tilt frame at an interface axis and an extendable length first intermediate actuator attached to the intermediate member and the tilt frame, and wherein the first interface actuator is attached to the intermediate member. The trailer is further disposable in: III. a compact position with the interfacing member disposed completely below the plane, the bridge securing means being incapable of securing a bridge to the interfacing member when in the compact position. The tilt axis is fixed relative to the trailer frame, and wherein the tilt frame and trailer frame are parallel in the normal position.

The present invention also is directed to a method of loading a bridge transporting and launching trailer and bridge mounted thereon into a compact space, wherein the trailer comprises: a trailer frame having right and left trailer frame members attached together and extending from a front to a back; right and left wheels mounted to a common wheel support removably attachable to the trailer frame and operable in a support position to support the trailer; a tilt frame having right and left tilt frame members attached together and extending from a front to a back the tilt frame pivotably attached at a tilt axis at the back of the trailer frame; a foot portion mounted at the back of the tilt frame and extending between the right and left tilt frame members; an extendable length first tilt actuator attached to the front of the tilt frame and attached to the trailer frame; an interfacing member operable to mount a bridge to the tilt frame, the interfacing member pivotably mounted at an interface axis disposed at the back of the tilt frame and including bridge securing means for selectively securing a bridge to the trailer; an extendable length first interface actuator attached to the interfacing member and operable to pivot the interfacing member; and wherein said bridge is secured to the bridge securing means; and the steps comprising: I. unsecuring the bridge from the bridge securing means on the interfacing member; II. moving the interfacing member from its normal bridge securing position wherein it is at least partially above a plane defined by top edges of the right and left trailer frame members into a compact position disposed completely below the plane; III. reducing the width of the bridge by decreasing the distance between treads of the bridge; and IV. removing the common wheel support from the trailer frame; and V. loading the common wheel support and the trailer into the compace space with the bridge on top of the trailer. The compact space may be an airplane cargo compartment. The trailer is loaded into the airplane cargo compartment by sliding the front of the trailer frame into the airplane cargo compartment prior to removing the common wheel support from the trailer frame, then removing the common wheel support, and sliding the remainder of the trailer frame into the airplane cargo compartment. The tilt axis is fixed relative to the trailer frame. The tilt frame is vertically within the trailer frame upon completion of the loading step.

BRIEF DESCRIPTION OF THE DRAWINGS

The above and other features of the present invention will be more easily understood when considered with the following detailed description in conjunction with the accompanying drawings wherein like characters represent like parts throughout the several views and in which.

DETAILED DESCRIPTION OF THE DRAWINGS

Figure 1:
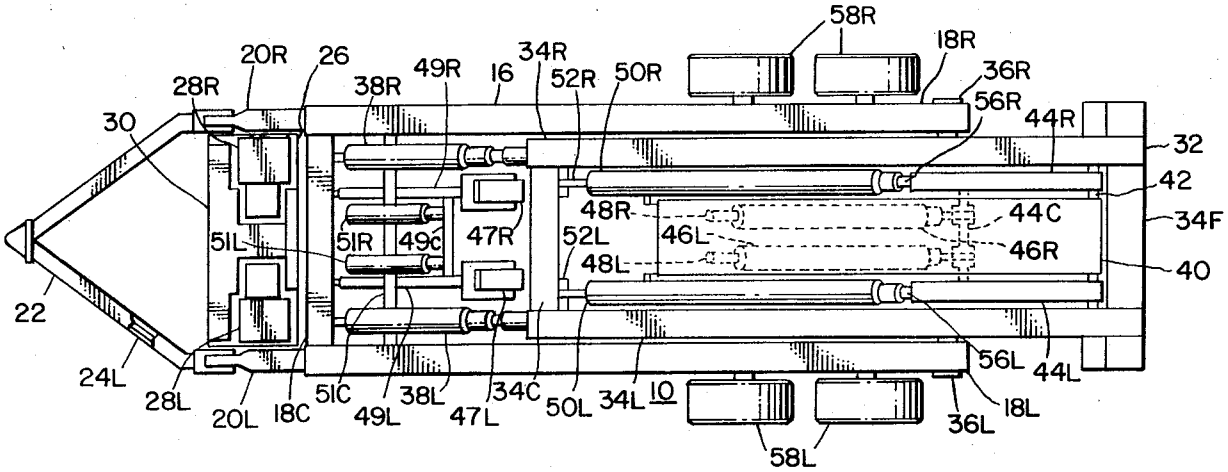
FIG. 1 shows a top view of a bridge transporting and launching trailer according to the present invention.
Figure 2:
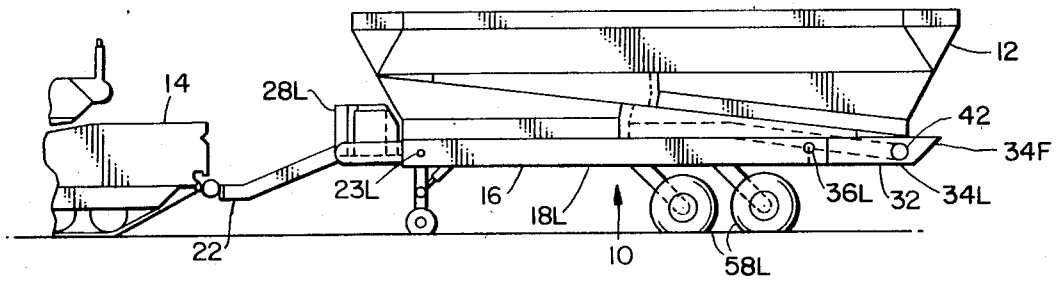
FIG. 2 shows a side view of the trailer of FIG. 1 with a bridge mounted thereon and attached to a towing vehicle.
Figure 3:
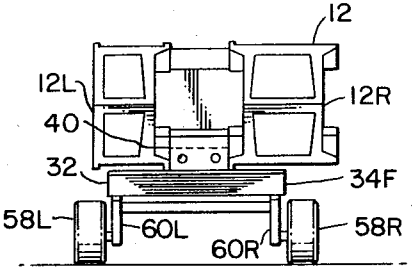
FIG. 3 shows an end view of the trailer and bridge of FIG. 2.

Turning now to FIGS. 1, 2, and 3, the bridge carrying and launching trailer 10 of the present invention will be discussed in detail. FIG. 1 shows a top view of the trailer 10, whereas FIG. 2 shows a side view of the trailer 10 with a bridge 12 mounted to the trailer 10 and with a tow vehicle 14 attached at the front of the trailer 10. FIG. 3 shows an end view of the trailer 10 and bridge 12.

The trailer 10 includes a trailer frame 16 having right and left trailer frame members 18R and 18L. Trailer frame members 18R and 18L are connected at their front ends by a cross trailer frame member 18C. Right and left side bars 20R and 20L are mounted to adjust the length of the trailer 10 by sliding within the trailer frame members 18R and 18L respectively. Attached at the front of the right and left side bars 20R and 20L is a trailer hitch member 22 shown only schematically. As shown by the partial break away of 22 in FIG. 1, a left control cord 24L may disposed within the trailer hitch member 22. The control cord could alternately be external to the hitch member 22. If desired, a similar right control cord could be used for a redundancy feature as discussed below. Alternately, a single control cord could be used.

The trailer hitch member 22 may be used to hitch the trailer 10 to a towing vehicle such as 14 as shown in FIG. 2. Numerous types of trailer hitch members could be used for the member 22 and the specifics of the hitching mechanism need not be discussed in detail. The electric control cord 24L (and a similar right control cord if desired) may include a plug or plugs (not shown) adjacent the apex or front of the hitch member 22 to allow attachment to corresponding electrical connectors mounted or extending from the towing vehicle 14. In this manner, electrical control signals from the vehicle 14 may be used to control the various functions of the trailer 10.

Extending between the side bars 20R and 20L is a power pack mounting plate 26. Mounted upon the power pack mounting plate 26 are two hydraulic power packs 28R and 28L. Each power pack includes a corresponding air cooled diesel internal combustion engine silent chain aluminum case gear box, and a light weight aircraft piston hydraulic pump similar to the type used on the M1 tank although the specific parts are not labeled because the details of the power packs 28R and 28L are not a necessary feature of the present invention. The gear box allows the corresponding hydraulic pump to run at a more efficient higher speed. The power packs provide hydraulic fluid under pressure to tubes (not shown) which supply various actuators on the trailer. Hydraulic reservoirs 30 are of light weight construction and surround the other parts of the power packs 28R and 28L to provide armor protection. The reservoirs 30 are filled with explosion suppressing material.

Figure 4:
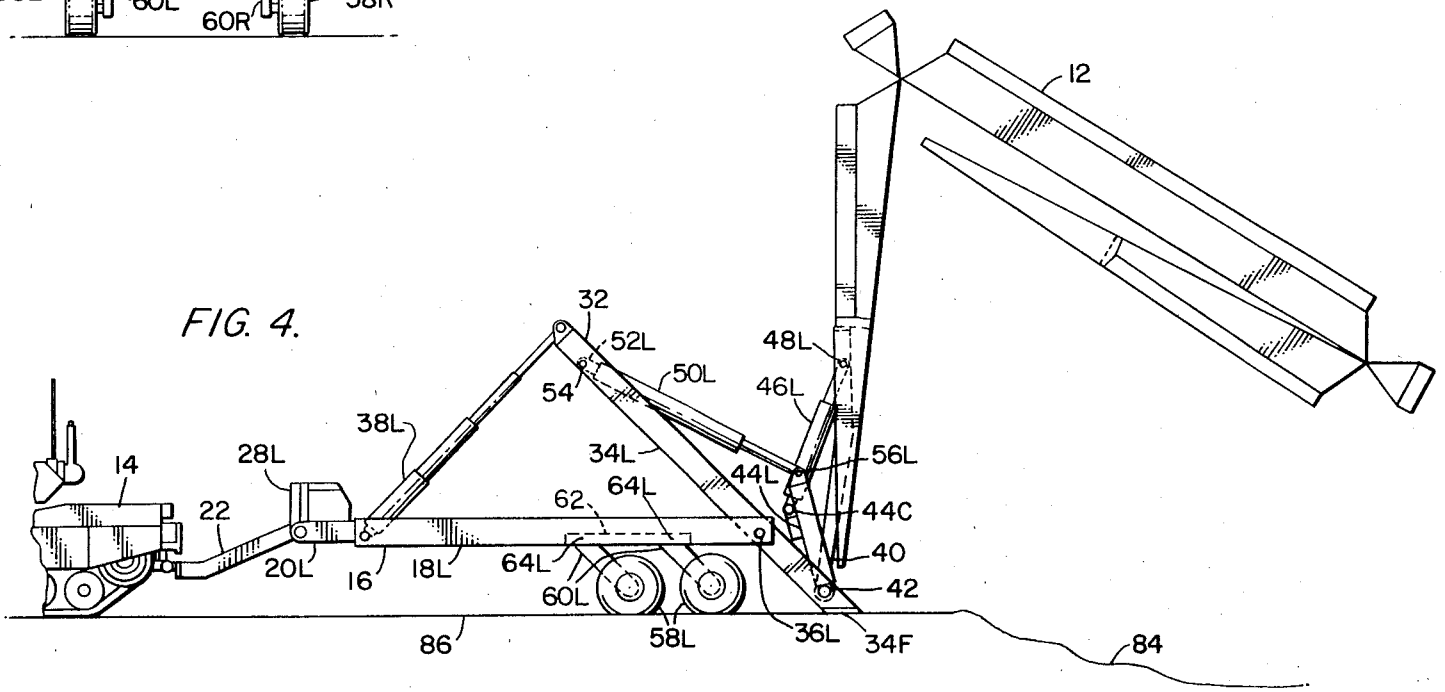
FIG. 4 shows the trailer, bridge, and towing vehicle of FIG. 2 with the trailer assuming a bridge launching position.

Continuing to view FIGS. 1, 2, and 3, but also considering FIG. 4, the wheel suspension system and bridge launching mechanism used with the trailer 10 will be discussed. FIG. 4 shows a side view of the trailer 10 as it is unfolding the bridge 12 and is attached to the towing vehicle 14.

A tilt frame 32 is mounted within the trailer frame 16 and includes right and left tilt frame members 34R and 34L. A tilt frame cross member 34C extends between the fronts of the right and left tilt frame members 34R and 34L. The tilt frame 32 is pivotably mounted to the trailer frame 16 at a tilt axis defined by the colinear right and left pivot pins 36R and 36L. A foot portion 34F closes the tilt frame 32 by extending between the back ends of the right and left tilt frame members 34R and 34L.

As is apparent from the showing in FIG. 2 at the top of tilt frame side 34L extends in line with the top plane of trailer frame member 18L, the tilt frame 16 is disposed completely at or below a plane defined by the right and left trailer frame members 18R and 18L. That is, the tilt frame 16 does not extend above that plane.

Extendable length tilt actuators 38R and 38L extend between the cross beam 18C at the front of trailer frame 16 and the fronts of the right and left tilt frame members 34R and 34L and are operable to pivot or tilt the tilt frame 32 relative to the trailer frame 16 as best shown in FIG. 4.

A tongue 40, which serves as an interfacing member between the trailer 10 and the bridge 12, is pivotably mounted to the tilt frame 32 by the tongue pivot pin 42 which extends between the tilt frame members 34R and 34L. Additionally mounted upon the tongue pivot pin 42 are intermediate right and left members or links 44R and 44L with an intermediate cross beam member 44C connected between them. Extendable length interface or tongue actuators 46R and 46L are pivotably attached at points 48R and 48L on the underside of the tongue 40. The interface or tongue actuators 46R and 46L have their opposite ends pivotably attached about the intermediate member cross beam 44C. Extendable length right and left intermediate actuators 50R and 50L are pivotably attached at respective pivot points 52R and 52L on the tilt frame cross member 34C. The pivot points 52R and 52L may be disposed at the inside corners between cross beam 34C and tilt frame members 34R and 34L and may include a pivot pin 54 (which extends to the far left surface of the tilt frame member 34L). If desired, the pivot pin 54 could be common to both pivot points 52R and 52L. Alternately, separate right and left pivot pins could be used for pivotably attaching the front ends of actuators 50R and 50L to the tilt frame 32. The opposite ends of the intermediate actuators 50R and 50L may be respectively pivotably connected to points 56R and 56L disposed at the front ends of the intermediate members 44R and 44L.

Two right wheels 58R and two left wheels 58L are mounted upon corresponding support arms 60R and 60L which extend downwardly and backwardly from a common wheel support plate 62 (FIG. 4 only) which is removably attached to the right and left trailer frame members 18R and 18L by quick release pins 64L and similar right side pins not shown. The wheels 58R and 58L are mounted upon a hydromatic suspension. Hydraulic actuators (not shown) are at the top of arms 60R and 60L to allow the support arms 60R and 60L to pivot to an angle depending upon the hydraulic pressure within the actuators, thus changing the height of the support plate 62. The hydraulic actuators are known hydraulic mechanisms which allow hydraulic rotation under pressure. The change in hydraulic pressure in the actuators and may move the trailer frame 16 up or down relative to the ground, by changing the angle of the support arms 60R and 60L.

Landing wheels 47R and 47L are mounted to swing support arms 49R and 49L which are pivotably attached at the rear edge of the trailer frame cross beam 18C. The support swing arms 49R and 49L are interconnected by a cross member 49 which has front or landing wheel actuators 51R and 51L pivotably attached to it. Additionally, the wheel actuators 51R and 51L are pivotably attached to a wheel actuator support rod 51C extending between right frame member 18R and left frame member 18L. The support rod 51C extends below actuators 38R and 38L and above the support arms 49R and 49L and allows the actuators 51R and 51L to rotate thereon. By operation of the actuators 51R and 51L, the wheels 47R and 47L can be moved from their retracted position shown in FIG. 1 to their supporting position shown in FIG. 2. The wheels 47R and 47L are used in their supporting position to allow disconnection between a towing vehicle 14 and the trailer 10 such that a different towing vehicle may be attached to the trailer 10. Other arrangements could be used for holding up the front of trailer 10 when it is not attached to a tow vehicle. Further, the landing wheels 47R and 47L are used to load the trailer 10 into an airplane cargo bay.

Figure 5:
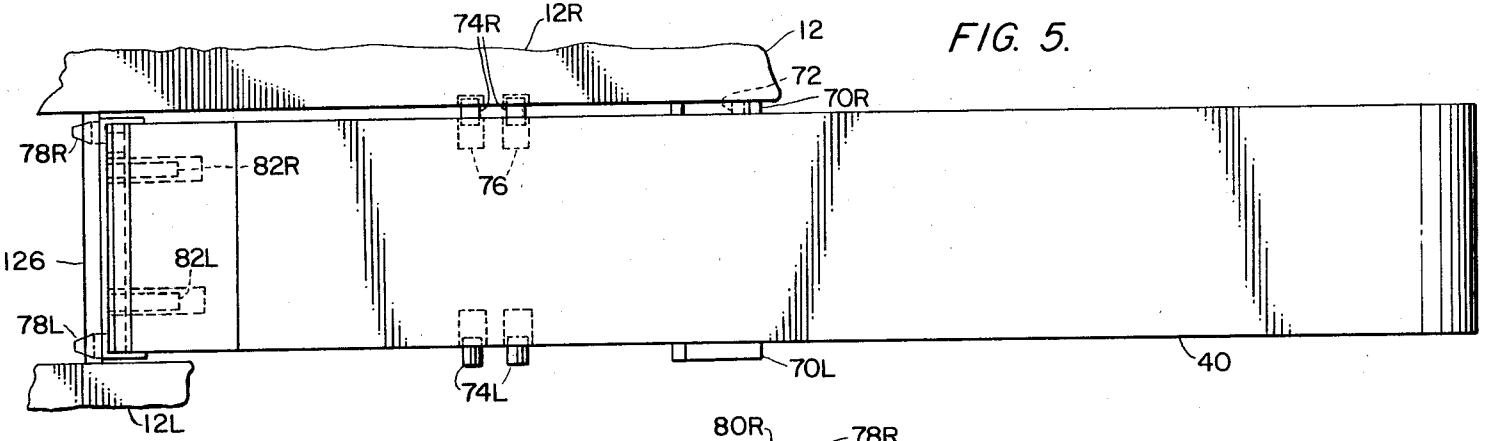
FIG. 5 shows a top view of an interfacing member and associated part of a bridge as used with the present invention.
Figure 6:
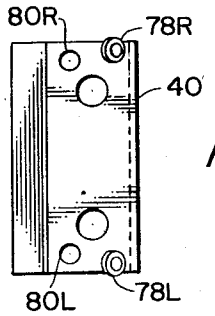
FIG. 6 shows an end view of the interfacing member of FIG. 5.
Figure 7:
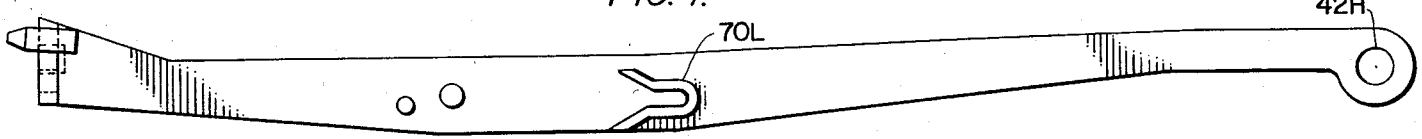
FIG. 7 shows a side view of the interfacing member of FIGS. 5 and 6.

Turning now to FIGS. 5, 6 and 7, the construction of the tongue or interfacing member 40 will be discussed in detail. FIG. 5 shows a top view of the tongue 40 as attached to bridge 12 shown with parts broken away for simplicity. FIG. 6 shows an end view of the tongue 40, whereas FIG. 7 shows a side of the tongue 40. The tongue 40 includes right and left guide slots 70R and 70L which cooperate with guide pins 72 (only the right one is shown in FIG. 5) mounted on each part 12R and 12L of the bridge 12. Hydraulic locking pins 74R cooperate with holes 76 on the right member 12R and pins 74L cooperate with similar holes (not shown) on member 12L to lock the tongue 40 in between the members 12R and 12L. Additionally, the tongue 40 will be held to the bridge 12 by bolts 78R and 78L which extend into mating holes in a cross beam bulkhead 12C extending between bridge members 12R and 12L. Similar bolts (not visible in FIG. 5) may extend from the bulk head 12C into mating holes 80R and 80L (see especially FIG. 6). Push off cylinders 82R and 82L (shown in a retracted position in FIG. 5) may be used to separate the tongue 40 from the bridge 12 in a manner discussed in detail below. The hole 42H (FIG. 7) in the tongue 40 is used to accommodate the tongue pivot rod 42 (FIG. 1).

Bridge Launching and Retrieving Operations

The bridge 12 may be launched and retrieved by the vehicle 10 by way of control from the towing vehicle 14. In particular, and concentrating on the view of FIG. 4, the trailer 10 is moved to be adjacent to the gap 84 which must be traversed. Although the trailer 10 could be backed up to the gap 84, the difficulty in backing up armored vehicles or tanks such as towing vehicle 14 may make it preferable to detach the trailer 10 from the towing vehicle 14 (with the landing wheels 47R and 47L in their down position of course) and push the trailer 10 (after lifting wheels 47R and 47L) into its launch position by attaching the trailer hitch member 22 to a cooperating trailer hitch attachment at the front of the tank 14.

When the trailer 10 is into position adjacent the gap 84 as shown in FIG. 4, the electric control cables such as 24L are used to actuate the power packs 28R and 28L. As will be readily appreciated, the trailer 10 is symmetric about a front to back center line. The hydraulic actuators on either side of the center line provide sufficient power to completely carry out the bridge launching or retrieving sequence. This duplication of hydraulic actuators on the right and left sides of the trailer 10 and the redundancy of having the separate right and left hydraulic power packs 28R and 28L is advantageous in that an enemy cannot prevent the bridge launching unless he disables both the right and left side hydraulic systems.

The bridge launching sequence will be described primarily with reference to the left side structural members and hydraulic actuators, it being understood that the right side members and hydraulic actuators operate identically and simultaneously. The hydraulic power pack 28L provides hydraulic pressure to extend the tilt actuator 38L from its retracted position (FIG. 1) to an extended position (FIG. 4) such that the front of the tilt frame 32 is pushed away from the front of the trailer frame 16. The tilt frame 32 pivots about tilt axis pin 36L such that the foot portion 34F touches the ground 86. This removes the weight from the wheels 58R and 58L and may even lift the wheels off the ground.

At the same time as the actuator 38L is assuming its extended position, the intermediate actuator 50L is hydraulically lengthened from its usual retracted position, thereby pivoting the intermediate members 44L and 44R relative to the tilt frame members 34L and 34R. At the same time, the tongue or interface actuator 46L is hydraulically lengthened from its normal retracted position, thereby pivoting the tongue 40 relative to the intermediate members 44L and 44R. Because the bridge 12 is attached to the tongue 40, it will likewise be pivoted relative to the tilt frame axis 32. The tongue 40 and bridge 12 will each change from being at an acute angle with respect to trailer frame 16 and tilt frame 32 to being at an obtuse angle with respect to the trailer frame 16 and tilt frame 32. Depending on ground conditions, the tongue 40 and bridge 12 may come to rest parallel to trailer frame 16. At the same time, the bridge 12, shown as a tri-section bridge, may be unfolding as shown in FIG. 4. In particular, the bridge 12 may use hydraulic actuators to unfold adjacent sections in a known manner. The bridge hydraulic actuators (not shown) may be powered by the same hydraulic power packs 28R and 28L which are used to control the hydraulic actuators of the trailer 10.

Upon the tilt frame 32 and bridge 12 reaching the positions shown in FIG. 4, the pressure in the hydraulic tilt actuator 38L is simply maintained while the pressure in the intermediate actuator 50L and the interface actuator 46L is increased until the tongue 40 is lying upon the ground, the bridge completely unfolding during this sequence such that it would extend across the gap 84.

In order to remove the tongue 40 from the bridge 12, the hydraulically controlled lock pins 74R and 74L (refer back to FIG. 5) are retracted into the tongue 40. The tongue 40 may then be pulled away from the bulk head 12C to free bolts 78R and 78L, either with or without the assistance of the hydraulically controlled push off cylinders 82R and 82L pushing against the bulk head or bridge cross beam 12C.

Having separated the tongue 40 from the bridge 12, the hydraulic actuators 46L, 50L, and 38L may be returned to their retracted positions as shown in FIGS. 1 and 2. The trailer 10 may be moved out of the way such that the tank 14 and/or other military vehicles may drive across the bridge 12, thereby overcoming the gap 84 which could be a tank ditch, or any of numerous natural obstacles.

In order to retrieve the bridge 12, the hydraulic actuators 38L, 50L, and 46L (and their corresponding right side actuators) are operated to place the tongue 40 in between the right and left bridge members 12R and 12L (refering now also to FIGS. 5–7). Preferably, the tongue 40 is placed along the ground with the foot portion 34F still slightly above the ground 86. The trailer 10 is then pushed towards the bridge 12 such that guide pins 72 slide into the guides 70R and 70L, thereby guiding the bolts 78R and 78L into mating holes on the bulk head or bridge cross beam 12C. Likewise, bolts (not shown) on the bridge cross member 12C may extend into the holes 80R and 80L. The hydraulically controlled locking cylinders or pins 74R and 74L may then be actuated to change from a retracted position recessed within the tongue 40 into a locking position (as shown in FIG. 5) extending out of the tongue 40. At this stage, the hydraulic tilt actuator 38L may be lengthened a slight additional amount to bring the foot portion 34F into solid contact with the ground 86 and to correspondingly take the weight off the wheels 58R and 58L and even lift them off the ground. The hydraulic actuators (not shown) of the bridge 12 may then be used to fold the bridge into the position shown in FIG. 4 at the same time as the actuators 50L and 46L are retracted to bring the tongue 40 and intermediate members 44L and 44R into the position shown in FIG. 4. Further retraction of the actuators 46L, 50L, and 38L will bring the bridge to rest upon the trailer 10, the bridge simultaneously continuing its folding operation. The bridge would thus have returned to the position shown in FIG. 2 and could be used at another location.

The bridge 12 is preferably a tri-section fold bridge adapted to be folded from either end. In this manner, the trailer 10 could unfold the bridge from one side of a gap and, after being towed across the bridge 12, could fold the bridge up from the other side of the gap.

Method of Loading and Unloading The Trailer Into A Compact Enclosure

Figure 8:
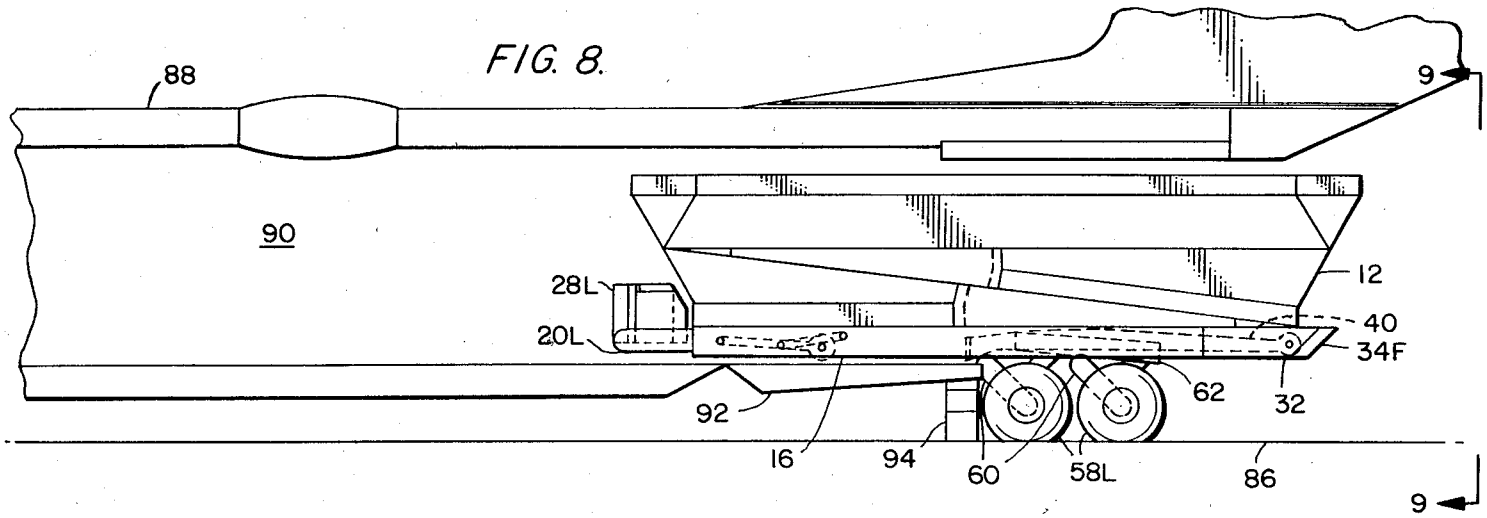
FIG. 8 shows a side view of the trailer and bridge of FIG. 2 partially loaded into the cargo bay of an airplane.
Figure 9:
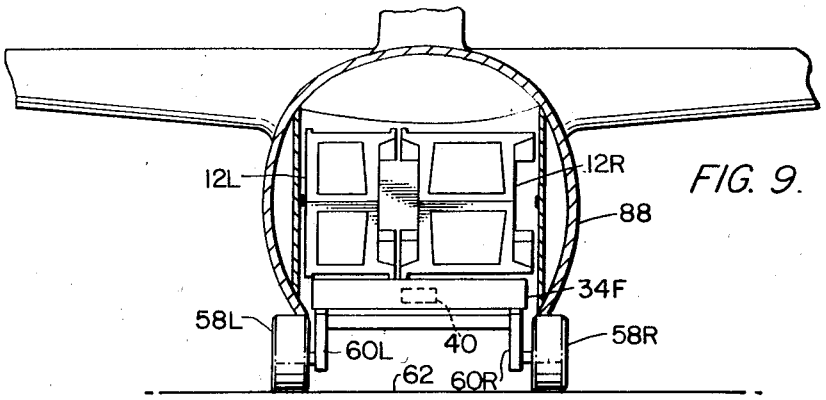
FIG. 9 shows an end view along lines 9—9 of FIG. 8.
Figure 10:
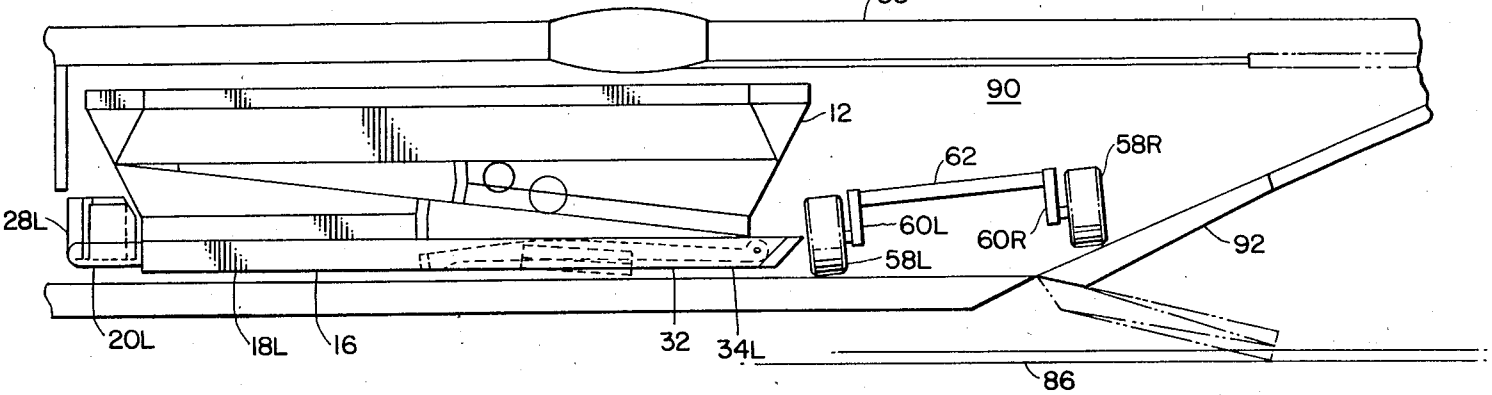
FIG. 10 shows the trailer and bridge completely loaded into the airplane cargo bay.

An important feature of the present invention is its ability to assume a compact position for loading into a carrier such as, for example, an airplane cargo bay or similar compartment. Turning now to FIGS. 8, 9, and 10 and also considering FIGS. 1, 2, and 3, the loading of the trailer 10 into the cargo bay 90 of airplane 88 (which may for example be a C-130) will be explained. Initially, the trailer 10 may be placed adjacent the cargo loading ramp 92 of the airplane 88. The trailer 10 is supported by its wheels 58R and 58L and by its landing wheels 47R and 47L. Because the front of the trailer 10 will be closest to the cargo loading ramp 92 of airplane 88, trailer 10 could be positioned by a winch (not shown) as commonly used to load airplanes. The winch may pull on a cable (not shown) secured to the trailer frame cross member 18C. The trailer hitch member 22 with associated pintle (FIGS. 1 and 2 only) may be already detached from the side bars 20R and 20L by removal of locking pins. Alternately, the member 22 may be pivoted up as discussed in detail below. The cargo loading ramp 92 is rotated up from the ground 86 to be roughly parallel with the floor of cargo bay 90 and a support 94 is placed into position to stabilize the cargo door 92.

A problem with storing the trailer 10 and the bridge 12 resting thereon within the cargo bay 90 is that the bridge 12 may be too wide for the cargo bay 90. As best shown in FIG. 3, the bridge 12 overlaps one side of the trailer 10. It will additionally be noted that the bridge 12 is nonsymmetric, i.e., its right side members 12R have a greater width than its left side members 12L. In order to overcome this problem, the bridge 12 has been designed to include hydraulic mechanisms to collapse the bridge sideways bringing bridge members 12R closer to the bridge members 12L (compare FIGS. 3 and 9). The bulkhead 12C is also hydraulically collapsible. Specifically, the hydraulic mechanisms allow the bridge 12 to be collapsed from approximately 150 inches in width to approximately 115 inches in width. Other bridge width reducing arrangements, as used in the art, such as scissor members in between the bridge members may alternately be used.

The width of the bridge 12 can not ordinarily be reduced to allow it to fit within the cargo bay 90 with the bridge 12 on trailer 10 because the tongue 40 is directly in between the members 12R and 12L (refer back momentarily to FIG. 5). In order to overcome this problem, the tongue 40 is unlocked from the bridge 12 by retracting the hydraulically controlled locking pins 74R and 74L (FIG. 5) and activating the hydraulically controlled push off cylinders 82R and 82L such that the bolts 78R and 78L and similar bolts on cross beam 12C will clear their respective holes. In other words, the push off cylinders 82R and 82L will push the bridge 12 forward relative to the tongue 40 such that bridge 12 is simply resting upon the trailer 10 without the bridge securing means or bolts 78R and 78L secured to the bridge. Brakes (not shown) on wheels 58R and 58L would be used to stabilize trailer 10 when separating tongue 40 from bridge 12.

Next, the tongue 40 is lowered down by retraction of interface actuators 46R and 46L in between the right and left tilt frame members 34R and 34L, which are in turn are in between the right and left trailer frame members 18R and 18L. The tongue or interfacing member 40 will thus be disposed below a plane defined by the upper edges of the trailer frame members 18R and 18L. By thus nesting the tongue 40 vertically within the trailer frame 16, it will no longer block the movement of the right bridge members 12R towards the left bridge members 12L. The bridge 12 is then hydraulically collapsed horizontally by moving the bridge members or treads 12R towards the bridge members or treads 12L as best shown in FIG. 9.

The trailer 10 is then winched closer to the cargo bay 90 until the front of the trailer frame 16 is just above the cargo door 92. The hydraulic actuators on arms 60L and 60R may then be adjusted to lower the trailer frame 16 such that its front is resting upon the cargo door 92, the landing wheels 47R and 47L being simultaneously adjusted. The trailer 10 will now be positioned with its front end resting on cargo door 92 and being supported by its landing wheels 47R and 47L and its wheels 58R and 58L.

The front landing wheels 47R and 47L may then be raised, the trailer 10 being supported by the cargo door 92 at its front and by its wheels 58R and 58L at its back. The trailer 10 is winched further into the cargo bay 90 to assume the position shown in FIG. 8. Upon assuming this position, the common wheel support plate 62 and associated wheels 58R and 58L and other equipment mounted on the support plate are then removed by operation or removal of pins 64L (FIG. 4 only), and similar pins on the right side. The trailer 10 and bridge 12 resting thereon may then be winched or otherwise disposed completely within the cargo bay 90 to assume the position shown in FIG. 10. Typically, the floor of the cargo bay 90 may include a plurality of rollers to facilitate the sliding of cargo into and out of the airplane 88. The wheel support plate 62 and the equipment mounted thereon including the wheels 58R and 58L may then be loaded into the cargo bay 90 as shown in FIG. 10 and the cargo door or loading ramp 92 may then be completely closed. The trailer hitch member 22 (not shown in FIG. 10) may be easily disposed on top of the common wheel support plate 62 or otherwise within the cargo bay 90. The trailer 10 will thus have assumed a compact position with the tongue or interfacing member 40 vertically within the trailer frame 16 instead of extending above the plane defined by the top edges of trailer frame members 18R and 18L. The compact position as shown in FIG. 10, also has the wheel support unit 62 separated from the trailer frame 16 with the wheels 58R and 58L no longer in their trailer supporting positions as shown in FIG. 2.

The unloading of the trailer 10 and associated bridge 12 essentially follows a reverse sequence to the above described loading operation. The cargo door or loading ramp 92 is opened and the common wheel support plate 62 and associated parts are removed from the cargo bay 90. A snatch block or vehicle is used to pull the trailer 10 with the bridge 12 resting on it sufficiently out of the cargo bay 90 to allow the common wheel support plate 62 to be attached to the trailer frame 16. The trailer 10 and bridge 12 will then be in the position of FIG. 8.

The trailer 10 is moved further out of the cargo bay 90 such that the landing wheels 47R and 47L may be lowered to support the trailer 10. The trailer 10 with the bridge 12 may then be pulled completely out of the cargo bay 90. The bridge 12 is hydraulically spread apart to its wide position with a substantial gap between its right members 12R and its left members 12L. The tongue 40 is hydraulically moved by actuators 46L and 46R into its normal position extending slightly above the top plane of the trailer frame 16 to the position shown in FIG. 3. In order to lock the bridge 12 into the tongue or interfacing member 40, brakes (not shown) on the wheels 58R and 58L are actuated to hold the trailer 12 in a fixed position. A snatch block or tow vehicle is then used to pull the bridge 12 slightly towards the rear of the stationary trailer 10 such that guide pins 72 and guides 70R and 70L (refer back to FIG. 5) cause the tongue 40 and its bolts 78R and 78L to seat within the bulk head or bridge cross beam 12C and allow activation of the hydraulic locking pins or cylinders 74R and 74L, thereby locking the bridge 12 to the trailer 10 by way of the tongue 40. The bridge 12 and trailer 10 will then in the position of FIG. 2 and the trailer hitch member 22 may be reconnected to the side bars 20R and 20L to allow the trailer 10 to be towed by a towing vehicle such as 14 in FIG. 2.

The trailer frame 16 is preferably constructed of high strength aluminum to allow the minimum total system weight. The tilt frame 32, tongue 40, and intermediate members 44R, 44L, and 44C are preferably constructed of high strength steel to allow the minimum space consumption of the multiple components and also result in minimum weight. Because of the lack of armor and relative simplicity of trailer 10, it will preferably weigh about 17,000 pounds. The bridge 12 may weigh about 13,000 pounds. The ratio of trailer weight to bridge weight should be about 1.5 or less, this being possible because the weight of the tow vehicle 14 is used to counter the moment on the trailer 10 when launching or retrieving bridge 12.

Figure 11:
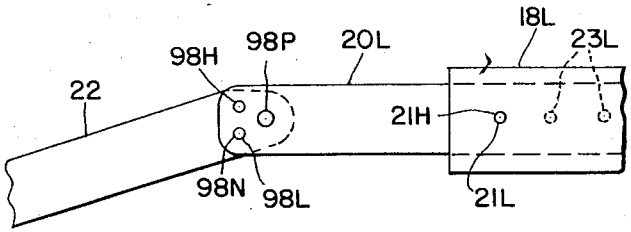
FIG. 11 is a detailed side view of parts of the present invention.

An important feature of the present invention is its operability with various sizes and weights of bridges. In particular, the hydraulic actuators on arms 60L and 60R may be used to adjust the trailer height depending upon the weight of the bridge which is mounted on the trailer. Additionally, as illustrated in FIG. 11, the length of the trailer 10 may be adjusted depending upon the length of the folded bridge which is to be mounted upon the trailer. FIG. 11 shows a view of the left side of trailer 10 with parts broken away for simplicity. The right side would be identically constructed. The length adjusting feature of the trailer 10 includes side bar locking pin 21L which may be used to lock the side bar 20L into various positions relative to the trailer frame member 18L. Specifically, the side bar member 20L telescopes relative to the frame member 18L. The pin 21L may extend through hole 21H in member 18L into one of a sequence of corresponding holes 23L in the side bar 20L. Adjustments to the length may be accomplished by removing the pin 21L (and a similar right-side pin), setting brakes on the wheels 58R and 58L, and pulling the side bars 20L and 20R further out of the trailer frame members 18R and 18L (or alternately pushing them further within the trailer frame members 18R and 18L). The pins such as 21L may be reinserted upon obtaining the desired length and having one of the axially spaced series of side bar holes such as 23L lined up with the trailer frame holes such as 21L. This process will be recognized as being somewhat similar to the manner in which semi-trailers for large trucks are adjusted.

The optional feature of having hitch member 22 pivotable relative to the side bars 20R and 20L is also illustrated by FIG. 11 showing the left side only, it again being understood that the right side would be identical. The member 22 is pivotably connected to side bar 20L by pivot pin 98P. However, in the normal position shown, locking pin 98L extends through hole 98N in bar 20L to a registry hole therebelow to lock member 22 relative to bar 20L. To pivot the proximate part of member 22 to be parallel to bar 20L, pin 98L is removed and inserted in hole 98H in bar 20L after rotating member 22 such that the registry hole of member 22 is below hole 98H instead of below hole 98N. The right side pin would be moved in a similar manner. The member 22 would thus be reoriented and would no longer extend below frame 16 in the manner shown in FIG. 2. The member 22 could then be kept attached to the trailer 10 when loading in the airplane in the above-described sequence.

Although various specific constructions and details have been discussed, it is to be understood that these are for illustrative purposes only. Various modifications and adaptations will be readily apparent to those of ordinary skill in the art. Accordingly, the scope of the present invention should be determined by reference to the claims appended hereto.

What is claimed is:

1. A method of loading a bridge transporting and launching trailer and bridge mounted thereon into a compact space, said trailer including:

(a) a wheeled trailer frame having a front and a back and right and left trailer frame members attached together and extending from the front to the back of said trailer frame;

(b) a common wheel support removably attachable to said trailer frame and operable in a support position to support the trailer;

(c) a tilt frame having a front and a back and right and left tilt frame members attached together and extending from the front to the back of said tilt frame, said tilt frame pivotably attached at a tilt axis at the back of said trailer frame;

(d) a foot portion mounted at the back of said tilt frame and extending between said right and left tilt frame members;

(e) an extendable length first tilt actuator attached to the front of said tilt frame and attached to said trailer frame;

(f) an interfacing member operable to mount a bridge to said tilt frame, said interfacing member pivotably mounted at an interface axis disposed at the back of said tilt frame and including bridge securing means for selectively securing a bridge to the trailer, said bridge secured to said bridge securing means; and (g) an extendable length first interface actuator attached to said interfacing member and operable to pivot said interfacing member; and the steps comprising:

I. unsecuring said bridge from said bridge securing means on said interfacing member;

II. moving said interfacing member from a normal bridge securing position wherein it is at least partially above a plane defined by top edges of said right and left trailer frame members into a compact position disposed completely below said plane;

III. reducing the width of said bridge by decreasing the distance between treads of the bridge;

IV. removing said common wheel support from said trailer frame; and

V. loading said trailer into said compact space with said bridge on top of said trailer frame and said common wheel support removed from its support position on said trailer frame.

2. The method of claim 1 wherein said compact space is an airplane cargo compartment.

3. A method of loading a bridge transporting and launching trailer and bridge secured thereon into a compact enclosure, wherein, said trailer includes:

(a) a wheeled trailer frame having a common wheel support;

(b) a tilt frame attached to said trailer frame; and (c) an interfacing member operable to secure the bridge to said tilt frame, and the steps comprising:

I. unsecuring said bridge from said interfacing member;

II. moving said interfacing member from a normal bridge securing position wherein it is at least partially above a plane defined by said trailer into a compact position disposed completely below said plane;

III. reducing the width of said bridge;

IV. removing the common wheel support from said trailer frame; and

V. loading said trailer with the common wheel support removed into said compact enclosure with said bridge on top of said trailer frame.

4. The method of claim 3 wherein said compact enclosure is a cargo compartment of an airplane.

5. A method of loading a bridge transporting and launching trailer and bridge mounted thereon into an airplane cargo compartment, said trailer including:

(a) a wheeled trailer frame having a front and a back and right and left trailer frame members attached together and extending from the front to the back of said trailer frame;

(b) a common wheel support removably attachable to said trailer frame and operable in a support position to support the trailer;

(c) a tilt frame having a front and a back and right and left tilt frame members attached together and extending from the front to the back of said tilt frame, said tilt frame pivotably attached at a tilt axis at the back of said trailer frame;

(d) a foot portion mounted at the back of said tilt frame and extending between said right and left tilt frame members;

(e) an extendable length first tilt actuator attached to the front of said tilt frame and attached to said trailer frame;

(f) an interfacing member operable to mount a bridge to said tilt frame, said interfacing member pivotably mounted at an interface axis disposed at the back of said tilt frame and including bridge securing means for selectively securing a bridge to the trailer, said bridge secured to said bridge securing means; and (g) an extendable length first interface actuator attached to said interfacing member and operable to pivot said interfacing member; and the steps comprising:

I. unsecuring said bridge from said bridge securing means on said interfacing member;

II. moving said interfacing member from a normal bridge securing position wherein it is at least partially above a plane defined by top edges of said right and left trailer frame members into a compact position disposed completely below said plane;

III. reducing the width of said bridge by decreasing the distance between treads of the bridge;

IV. removing said common wheel support from said trailer frame;

V. loading said trailer into said compartment with said bridge on top of said trailer frame and said common wheel support removed from its support position on said trailer frame, and said trailer is loaded into said airplane cargo compartment by sliding said front of said trailer frame into said airplane cargo compartment prior to removing said common wheel support from said trailer frame, then removing said common wheel supoort and sliding the remainder of said trailer frame into said airplane cargo compartment.

6. The method of claim 5 wherein said tilt axis is fixed relative to said trailer frame.

7. The method of claim 6 wherein said tilt frame is disposed vertically within said trailer frame upon completion of said loading step.

8. A method of loading a bridge transporting and launching trailer and bridge secured thereon into an airplane cargo compartment, wherein, said trailer includes:

(a) a wheeled trailer frame having a common wheel support;

(b) a tilt frame attached to said trailer frame; and (c) an interfacing member operable to secure the bridge to said tilt frame, and the steps comprising:

I. unsecuring said bridge from said interfacing member;

II. moving said interfacing member from a normal bridge securing position wherein it is at least partially above a plane defined by said trailer into a compact position disposed completely below said plane;

III. reducing the width of said bridge;

IV. removing the common wheel support from said trailer frame;

V. loading said trailer with the common wheel support removed into said compact enclosure with said bridge on top of said trailer frame, and wherein said trailer is loaded into said airplane cargo compartment by sliding said front of said trailer frame into said airplane cargo compartment prior to removing said common wheel support from said trailer frame, then removing said common wheel support and sliding the remainder of said trailer frame into said airplane cargo compartment.

9. The method of claim 8 wherein said tilt frame tilts about a tilt axis which is fixed relative to said trailer frame.

10. The method of claim 9 wherein said tilt frame is disposed vertically within said trailer frame upon completion of said loading step.

11. A bridge transporting and launching trailer comprising:

(a) a wheeled trailer frame having a front and back and right and left trailer frame members attached together and extending from the front to the back of said trailer frame;

(b) a tilt frame having a front and a back and right and left tilt frame members attached together and extending from the front to the back of said tilt frame, said tilt frame being pivotably attached at a fixed tilt axis at the back of said trailer frame;

(c) a foot portion mounted at the back of said tilt frame and extending between said right and left tilt frame members;

(d) an extendable length first tilt actuator attached to the front of said tilt frame and attached to said trailer frame;

(e) an interfacing member operable to mount a bridge to said tilt frame, said interfacing member being pivotably mounted at an interface axis disposed at the back of said tilt frame and including bridge securing means for selectively securing a bridge to the trailer; and (f) an extendable length first interface actuator attached to said interfacing member and operable to pivot said interfacing member; and wherein said trailer is disposable in:

I. a normal position for carrying a bridge and having said tilt frame disposed completely at or below a plane defined by top edges of said right and left trailer frame members, said first tilt actuator in a retracted position, and said first interface actuator in a retracted position; and II. a launch position for launching a bridge and having said tilt frame tilted about said tilt axis relative to said trailer frame, said foot portion on the ground, said first tilt actuator in an extended position, and said first interface actuator in an extended position.

12. The trailer of claim 11 wherein the trailer is adjustable in length to accommodate different length bridges.

13. The trailer of claim 11 wherein the trailer is operable to avoid tipping during the launching a bridge by relying upon the weight of a vehicle attached to the front of the trailer.

14. The trailer of claim 11 wherein, in said normal position, said interfacing member extends at least partially above said plane for attachment of said bridge securing means to a bridge.

15. The trailer of claim 14 wherein said trailer is further disposable in:

III. a compact position with said interfacing member disposed completely below said plane.

16. A bridge transporting and launching trailer comprising:

(a) a wheeled trailer frame having a front and a back and right and left trailer frame members attached together and extending from the front to the back of said trailer frame;

(b) a tilt frame having a front and a back and right and left tilt frame members attached together and extending from the front to the back of said tilt frame, said tilt frame being pivotably attached at a tilt axis at the back of said trailer frame;

(c) a foot portion mounted at the back of said tilt frame and extending between said right and left tilt frame members;

(d) an extendable length first tilt actuator attached to the front of said tilt frame and attached to said trailer frame;

(e) an interfacing member operable to mount a bridge to said tilt frame, said interfacing member being pivotably mounted at an interface axis disposed at the back of said tilt frame and including bridge securing means for selectively securing a bridge to the trailer; and (f) an extendable length first interface actuator attached to said interfacing member and operable to pivot said interfacing member; and wherein said trailer is disposable in:

I. a normal position for carrying a bridge and having said front of said tilt frame relatively close to said front of said trailer frame, said first tilt actuator in a retracted position, said first interface actuator in a retracted position, and said interfacing member extending at least partially above a plane defined by upper edges of said right and left trailer frame members to allow attachment of said bridge securing means to a bridge;

II. a launch position for launching a bridge and having said tilt frame tilted about said tilt axis relative to said trailer frame such that said front of said tilt frame is relatively far from said front of said trailer frame, said foot portion on the ground, said first tilt actuator in an extended position, and said first interface actuator in an extended position; and III. a compact position with said interfacing member disposed completely below said plane, said bridge securing means being incapable of securing a bridge to said interfacing member when in the compact position.

17. The trailer of claim 16 wherein said tilt frame and said trailer frame are parallel in said normal position.

18. The trailer of claim 16 further comprising a control cord extending from the trailer and operable to control the launching of a bridge from the trailer by an operator in another vehicle.

19. The trailer of claim 16 wherein the trailer is operable to avoid tipping during the launching a bridge by relying upon the weight of a vehicle attached to the front of the trailer.

20. The trailer of claim 19 wherein said tilt axis is fixed relative to said trailer frame.

21. A bridge transporting and launching trailer comprising:

(a) a trailer frame having a front and a back and right and left trailer frame members attached together and extending from the front to the back of said trailer frame;

(b) right and left wheels mounted beneath and to said trailer frame and operable in a support position to support the trailer frame;

(c) a tilt frame having a front and a back and right and left tilt frame members attached together and extending from the front to the back of said tilt frame, said tilt frame being pivotably attached at a tilt axis at the back of said trailer frame;

(d) a foot portion mounted at the back of said tilt frame and extending between said right and left tilt frame members;

(e) an extendable length first filt actuator attached to the front of said tilt frame and attached to said trailer frame;

(f) an interfacing member operable to mount a bridge to said tilt frame, said interfacing member being pivotably mounted at an interface axis disposed at the back of said tilt frame and including bridge securing means for selectively securing a bridge to the trailer; and (g) an extendable length first interface actuator attached to said interfacing member and operable to pivot said interfacing member; and wherein said trailer is disposable in:

I. a normal position for carrying a bridge and having said front of said tilt frame relatively close to said front of said trailer frame, said first tilt actuator in a retracted position, said first interface actuator in a retracted position, and said interfacing member extending at least partially above a plane defined by top edges of said right and left trailer frame members to allow attachment of said bridge securing means to a bridge;

II. a launch position for launching a bridge and having said tilt frame tilted about said tilt axis relative to said trailer frame such that said front of said tilt frame is relatively far from said front of said trailer frame, said foot portion is on the ground, said first tilt actuator is in an extended position and said first interface actuator is in an extended position; and wherein said right and left wheels are mounted to a common wheel support removably attachable to said trailer frame.

22. The trailer of claim 21 wherein said tilt axis is fixed relative to said trailer frame, and wherein said tilt frame and said trailer frame are parallel in said normal position.

23. The trailer of claim 21 further comprising a control cord extending from the trailer and operable to control the launching of a bridge from the trailer by an operator in another vehicle.

24. The trailer of claim 23 wherein said trailer is further disposable in:

III. a compact position with said interfacing member disposed completely below said plane, said bridge securing means being incapable of securing a bridge to said interfacing member when in the compact position.

25. The trailer of claim 23 wherein the trailer is operable to avoid tipping during the launching a bridge by relying upon the weight of a vehicle attached to the front of the trailer.

26. The trailer of claim 25 further comprising an intermediate member pivotably attached to said tilt frame at said interface axis and an extendable length first intermediate actuator attached to said intermediate member and said tilt frame, and wherein said first interface actuator is attached to said intermediate member.

27. A bridge transporting lauching trailer comprising:

(a) a wheeled trailer frame having a front and back and right and left trailer frame members attached together and extending from the front to the back of said trailer frame;

(b) a tilt frame having a front and a back and right and left tilt frame members attached together and extending from the front to the back of said tilt frame, said tilt frame being pivotably attached at a fixed tilt axis at the back of said trailer frame;

(c) a foot portion mounted at the back of said tilt frame and extending between said right and left tilt frame members;

(d) an extendable length first tilt actuator attached to the front of said tilt frame and attached to said trailer frame;

(e) an interfacing member operable to mount a bridge to said tilt frame, said interfacing member being pivotably mounted at an interface axis disposed at the back of said tilt frame and including bridge securing means for selectively securing a bridge to the trailer; and (f) an extendable length first interface actuator attached to said interfacing member and operable to pivot said interfacing member; and wherein said trailer is disposable in:

I. a normal position for carrying a bridge and having said tilt frame disposed completely at or below a plane defined by top edges of said right and left trailer frame members, said first tilt actuator in a retracted position, and said first interface actuator in a retracted position;

II. a launch position for launching a bridge and having said tilt frame tilted about said tilt axis relative to said trailer frame, said foot portion on the ground, said first tilt actuator in an extended position, and said first interface actuator in an extended position; and III. a compact position with said interfacing member disposed completely below said plane, said interfacing member in said normal position extending at least partially above said plane for attachment of said bridge securing means to a bridge, and said trailer frame including right and left wheels mounted to said frame and operable in a support position to support the trailer frame and wherein, in said compact position, said right and left wheels are moved out of their support positions.

28. The trailer of claim 27 further comprising an extendable length second tilt actuator attached to the front of said tilt frame and attached to said trailer frame, and an extendable length second interface actuator attached to said interfacing member and operable to pivot said interfacing member.

29. The trailer of claim 27 wherein said right and left wheels are mounted to a common wheel support removably attachable to said trailer frame, and, in said compact position, said common wheel support is removed from said trailer frame.

30. The trailer of claim 29 further comprising an intermediate member pivotably attached to said tilt frame at said interface axis and an extendable length first intermediate actuator attached to said intermediate member and said tilt frame, and wherein said first interface actuator is attached to said intermediate member.

31. A bridge transporting and launching trailer comprising:

(a) a wheeled trailer frame having a front and a back and right and left trailer frame members attached together and extending from the front to the back of said trailer frame;

(b) a tilt frame having a front and a back and right and left tilt frame members attached together and extending from the front to the back of said tilt frame, said tilt frame being pivotably attached at a tilt axis at the back of said trailer frame;

(c) a foot portion mounted at the back of said tilt frame and extending between said right and left tilt frame members;

(d) an extendable length first tilt actuator attached to the front of said tilt frame and attached to said trailer frame;

(e) an interfacing member operable to mount a bridge to said tilt frame, said interfacing member being pivotably mounted at an interface axis disposed at the back of said tilt frame and including bridge securing means for selectively securing a bridge to the trailer; and (f) an extendable length first interface actuator attached to said interfacing member and operable to pivot said interfacing member; and wherein said trailer is disposable in:

I. a normal position for carrying a bridge and having said front of said tilt frame relatively close to said front of said trailer frame, said first tilt actuator in a retracted position, said first interface actuator in a retracted position, and said interfacing member extending at least partially above a plane defined by upper edges of said right and left trailer frame members to allow attachment of said bridge securing means to a bridge;

II. a launch position for launching a bridge and having said tilt frame tilted about said tilt axis relative to said trailer frame such that said front of said tilt frame is relatively far from said front of said trailer frame, said foot portion on the ground, said first tilt actuator in an extended position, and said first interface actuator in an extended position; and III. a compact position with said interfacing member disposed completely below said plane, said bridge securing means being incapable of securing a bridge to said interfacing member when in the compact position, and said trailer frame including right and left wheels mounted to said trailer frame and operable in a support position to support the trailer and wherein, in said compact position, said right and left wheels are moved out of their support positions.

32. The trailer of claim 31 wherein said right and left wheels are mounted to a common wheel support removably attachable to said trailer frame, and, in said compact position, said common wheel support is removed from said trailer frame.

33. A bridge transporting and launching trailer comprising:

(a) a wheeled trailer frame having a front and a back and right and left trailer frame members attached together and extending from the front to the back of said trailer frame;

(b) a tilt frame having a front and a back and right and left tilt frame members attached together and extending from the front to the back of said tilt frame, said tilt frame being pivotably attached at a tilt axis at the back of said trailer frame;

(c) a foot portion mounted at the back of said tilt frame and extending between said right and left tilt frame members;

(d) an extendable length first tilt actuator attached to the front of said tilt frame and attached to said trailer frame;

(e) an interfacing member operable to mount a bridge to said tilt frame, said interfacing member being pivotably mounted at an interface axis disposed at the back of said tilt frame and including bridge securing means for selectively securing a bridge to the trailer; and (f) an extendable length first interface actuator attached to said interfacing member and operable to pivot said interfacing member; and wherein said trailer is disposable in:

I. a normal position for carrying a bridge and having said front of said tilt frame relatively close to said front of said trailer frame, said first tilt actuator in a retracted position, said first interface actuator in a retracted position, and said interfacing member extending at least partially above a plane defined by upper edges of said right and left trailer frame members to allow attachment of said birdge securing means to a bridge;

II. a launch position for launching a bridge and having said tilt frame tilted about said tilt axis relative to said trailer frame such that said front of said tilt frame is relatively far from said front of said trailer frame, said foot portion on the ground, said first tilt actuator in an extended position, and said first interface actuator in an extended position; and III. a compact position with said interfacing member disposed completely below said plane, said bridge securing means being incapable of securing a bridge to said interfacing member when in the compact position, and further comprising an intermediate member pivotable attached to said tilt frame at said interface axis and an extendable length first intermediate actuator attached to said intermediate member and said tilt frame, and wherein said first interface actuator is attached to said intermediate member, and wherein the trailer is adjustable in length to accommodate various length bridges.

* * * * *

UNITED STATES PATENT AND TRADEMARK OFFICE

CERTIFICATE OF CORRECTION

PATENT NO. : 4,602,399

DATED : July 29, 1986

INVENTOR(S) : Jenkins

It is certified that error appears in the above-identified patent and that said Letters Patent is hereby corrected as shown below:

Line 9 column 19 delete [filt] add --tilt--.

Signed and Sealed this

Seventh Day of October, 1986

[SEAL]

*Attest:*

DONALD J. QUIGG

*Attesting Officer*

*Commissioner of Patents and Trademarks*